US005261581A

United States Patent [19]

Harden, Sr.

[11] Patent Number: 5,261,581

[45] Date of Patent: Nov. 16, 1993

[54] HOLSTER FOR BOW STRING RELEASE OR TOOL

[76] Inventor: Ralph E. Harden, Sr., 262 Fawn Trail, Lake Jackson, Tex. 77566

[21] Appl. No.: 867,131

[22] Filed: Apr. 10, 1992

[51] Int. Cl.[5] ..... F41B 5/00

[52] U.S. Cl. ..... 224/219; 224/916; 224/222; 224/267; 124/23.1; 124/90; 124/35.2

[58] Field of Search ..... 224/196-200, 224/218-222, 267, 916, 270; 124/23.1, 31, 33, 35.1, 35.2, 36, 40, 41.1, 86, 90, 91, 32, 34; 623/64, 65; 446/473, 489; 294/25, 26, 137, 141, 142, 167-169, 902; 24/460-462; 15/143.1; 16/324-326, 336; 403/110, 49, 83, 81, 92, 93; 292/267, 270, 285, 304-306

[56] References Cited

U.S. PATENT DOCUMENTS

| | | | |
|---|---|---|---|
| 1,453,989 | 5/1923 | Norlund | 403/83 |
| 2,989,356 | 6/1961 | Semmelroth | 403/83 |
| 3,006,678 | 10/1961 | Johnson | 294/26 |
| 3,060,625 | 10/1962 | Glass et al. | 224/267 |
| 3,072,115 | 1/1963 | Johnson | 124/35.2 |
| 4,041,926 | 8/1977 | Tromcoso, Jr. et al. | 124/35.2 |
| 4,121,605 | 10/1978 | Schmerl | 403/93 |
| 4,426,989 | 1/1984 | Sutton | 124/35.2 |
| 4,458,659 | 7/1984 | Troncoso, Jr. | 124/35.2 |
| 4,509,497 | 4/1985 | Garvison | 124/35.2 |
| 4,613,179 | 9/1986 | Van Zelm | 294/25 |
| 4,733,808 | 3/1988 | Turner et al. | 224/219 |
| 4,831,997 | 5/1989 | Greene | 124/35.2 |
| 4,909,232 | 3/1990 | Carella | 124/35.2 |
| 4,981,128 | 1/1991 | Garvison | 124/90 |
| 5,009,214 | 4/1991 | Wilde | 124/35.2 |
| 5,020,508 | 6/1991 | Greene | 124/35.2 |

OTHER PUBLICATIONS

Catalogue entitled "Bowhunters Magazine," late summer edition 1992, p. 12.

Catalog entitled "Bowhunters Discount Warehouse, Inc.," late summer edition 1991, pp. 66,68.

*Primary Examiner*—Ernest G. Cusick

*Attorney, Agent, or Firm*—Browning, Bushman, Anderson & Brookhart

[57] ABSTRACT

A holster for a bow string release or other tool comprises a base mountable on the inner forearm of a user and an elongate carrier pivotally connected to the base for free swinging movement from a position overlying the base and the user's forearm to a position projecting forward from the base along the user's hand. The free end of the carrier carries the bow string release. The base and the carrier have inter-engageable latches for releaseably retaining the carrier in a stowed position overlying the base, and an actuator has a portion projecting laterally for selectively releasing the latches. A load bearing strap is attached to the carrier on an outer portion thereof, which can telescope with respect to an inner portion.

24 Claims, 3 Drawing Sheets

FIG. 4
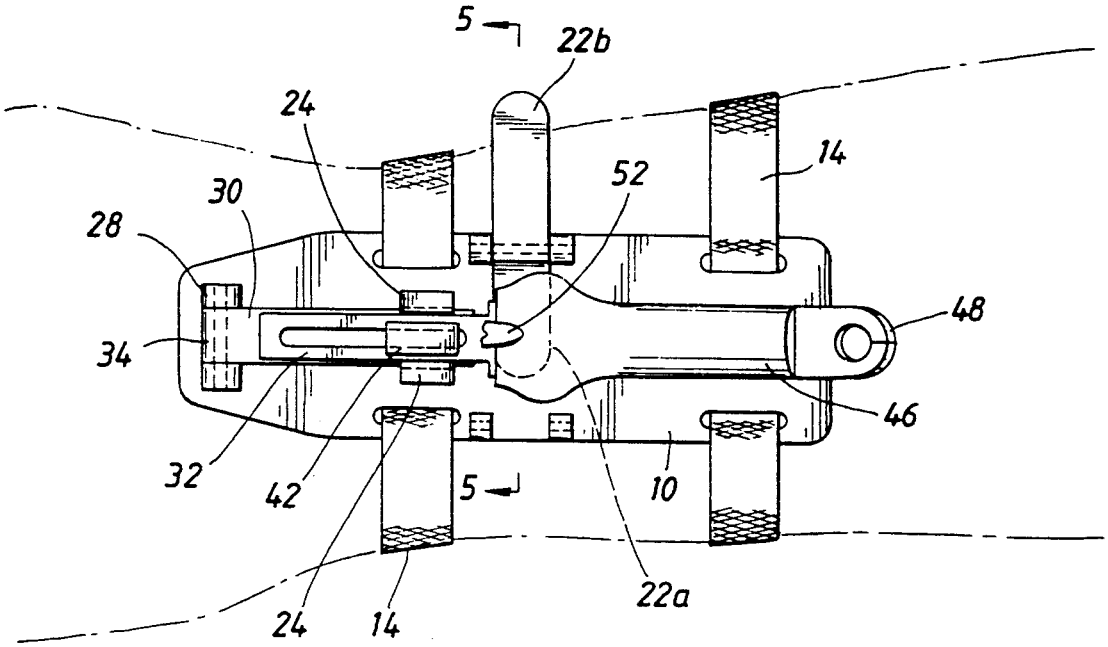
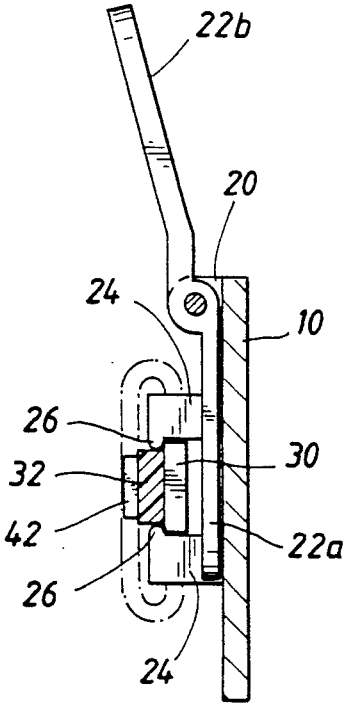
FIG. 5
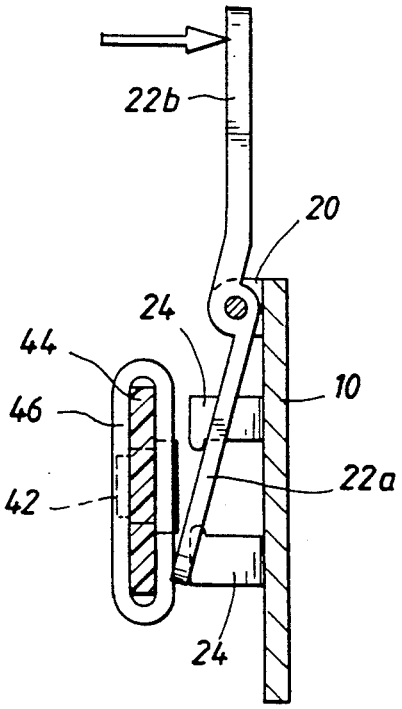
FIG. 6

HOLSTER FOR BOW STRING RELEASE OR TOOL

BACKGROUND OF THE INVENTION

Field of the Invention

The art of archery bows has advanced greatly in recent times. Modern "high-tech" bows are so sensitive that, if the archer draws the bow string with two fingers, both fingers would have to be released at precisely the same moment in order to avoid thwarting the technology and sensitivity of the bow. It is, however, virtually impossible for the archer to release both fingers simultaneously with any degree of consistency.

This is one reason for the increased use of mechanical bow string releases by modern archers. Such releases have means such as opposable jaws for engaging and pulling the bow string, with release of the string being effected by the user moving a single trigger-like projection.

Releases can be generally subdivided into two broad categories, depending upon their manner of interfacing with the archer. One such category is the so called "pistol grip" type, the main characteristic of which is more or less self-descriptive. An example is the "cobra pro caliper target" shown on page 66 of a catalog entitled "Bow Hunters Discount Warehouse, Inc.," late summer edition 1991. The other main category is the so called "center mount" type, examples being the "Martin Quicksilver, Release" and the "Pro-release Trophy Hunter" on page 68 of the aforementioned catalog.

The center mount type release includes a strap which is placed around the base of the user's hand, so that the force of drawing the string can be taken at the base of the hand, rather than at the fingertips. The release is linked to the wrist strap, sometimes by a swivel type connection, and the user's fingers only need to operate the release trigger, not apply any force to the bow string directly. A more detailed illustration and description of a center mount type release may be found in U.S. Pat. No. 5,020,508 to Greene.

A problem with these mechanical releases is that when not in use, as when the archer is pulling arrows from a target, climbing a tree, or sitting in the tree for a long period of time waiting for a deer, they can become lost or mislaid. Even if the archer remembers, for example, to put the release in a pocket or hunting bag, it is difficult to access the release and properly mount it on the wrist quickly enough for hunting. On the other hand, if the archer leaves the device properly mounted all the time, it is awkward and obtrusive, particularly when trying to do other things, such as climb a tree, handle arrows, etc.

U.S. Pat. No. 3,060,625 to Glass et al shows a device having an arm band to which a toy derringer is pivotally connected so that it can lie in a concealed position along the user's arm and swing quickly into the palm, presumably for a surprise or joking effect. This apparatus is unsuitable for stowing and accessing a bow release for several reasons. First, the Glass et al device is unduly complicated. It is spring loaded, so that it would often be too noisy for deer hunting. The "trigger" by which the derringer is caused to swing into the palm of the user's hand is located adjacent the hand so that it can be actuated by simply bending the wrist. This may be beneficial in a joke or toy gun context, but it would be inconvenient for an archer, who might accidentally release the device by bending the wrist for other purposes, and this inconvenience would be exacerbated by the aforementioned spring-loaded nature of the device.

The Glass et al device does not provide any flexibility for ensuring that the toy gun fits properly in the palms of different users, the sizes of whose arms and hands will vary. Again, this might be acceptable in a toy or joke context. However, for an archer, it is imperative that the wrist strap, pistol grip, or other interface device properly fit the user's hand, so that the force exerted on the bow string is taken directly on that hand, and that the release be able to self-align with the bow string.

Finally, the Glass et al device does not adequately accommodate the shape of the base of the hand and wrist, and movements thereof, and could cause a binding effect or sensation.

SUMMARY OF THE INVENTION

The present invention provides a holster which allows a bow string release or other tool to be stowed adjacent a user's forearm but quickly and easily accessed when its use is desired.

More specifically, a device according to the present invention comprises a base adapted to be releasably mounted on the inner forearm of a user and an elongate carrier having a connector end pivotally connected to the base for movement of the carrier between a stowed position overlying the base and an extending position projecting forward from the base for alignment with the user's hand. The carrier also has a free end for carrying a bow string release or other tool. The base and the carrier have inter-engageable latching formations for releasably retaining the carrier in its stowed position and an actuator inter-engageable between the base and the carrier for selectively releasing the latching formations.

In a preferred embodiment according to one aspect of the invention, a load bearing wrist strap, forming a closed loop, or a pistol grip, or some other interface device for transferring loads from the bow string release to the user's hand, is attached to the carrier. The pivotable connection between the base and the carrier is of a free-swinging, rather than spring-loaded type. This eliminates noise, which is an important factor in deer hunting, and also makes it easier for the user to selectively swing the carrier into or out of operative position. For example, the archer may wish to release the device, but may then need, for example, to take out a new arrow and apply it to the bow, to move to a slightly different position in a tree or blind, or the like. This would be inconvenient if, as in the Glass et al device, the carrier were being actively urged into the palm of the user's hand by a spring.

In preferred embodiments, and according to another aspect of the invention, the carrier is adapted for lengthwise extension and foreshortening. This allows adjustment of a standard device to fit users having different sized hands and arms. Thus the wrist strap or other interface device can properly engage any archer's hand so that hand takes the force of the bow string independently of the carrier, rather than having that force transferred by the carrier to the base and the user's arm. It has been found, somewhat surprisingly, that a device which transfers the force to the user's arm does not work well. For this same reason, it is preferable that the interface device be connected to the carrier such that it moves with the free end thereof.

In a particularly preferred embodiment, the parts of the carrier which provide the aforementioned telescopic movement also serve a dual function as part of the latch means.

It is also preferable that the free end of the carrier be permitted to swivel with respect to the connector end. Thus, the bow string release attached to the free end of the carrier can be properly positioned on the bow string without applying any undesired torque to that string.

In accord with still another aspect of the invention, and in preferred embodiments, the actuator for releasing the latch means has a portion projecting laterally from the base when the device is in the stowed position. Preferably, this projecting portion is a lever arm. This allows easy release of the latch means, as by moving the arm on which the device is mounted so that the projecting portion of the actuator is brushed against any nearby object, e.g. a tree or blind in which a hunter is sitting, the archer's leg, etc. Yet, movements of the user's wrist or other joints, as during climbing, taking up the bow and arrows, fixing the arrow on the bow string, etc. will not cause premature or inadvertent release. The parts are preferably contoured to accommodate the curve of the hand.

As indicated, while the holster is particularly suitable for carrying a bow string release, it is also useful for other hand tools used frequently but not constantly. For example, a plant worker who repeatedly uses a small wrench, a lecturer using a felt-tip marker, or a grocery stocker using a price stamp could employ such a holster.

Still other features and advantages of preferred embodiments of the invention will be described below.

BRIEF DESCRIPTION OF THE DRAWINGS

FIG. 4 is a bottom plan view of FIG. 3 but with the wrist strap broken away.

FIG. 5 is a transverse view taken along the line 5—5 in FIG. 4, but with some of the T-head broken away to more clearly show the latch formations.

FIG. 6 is a view similar to FIG. 5, but showing the latch formations released, and without the T-head broken away.

DETAILED DESCRIPTION

Figure 1:
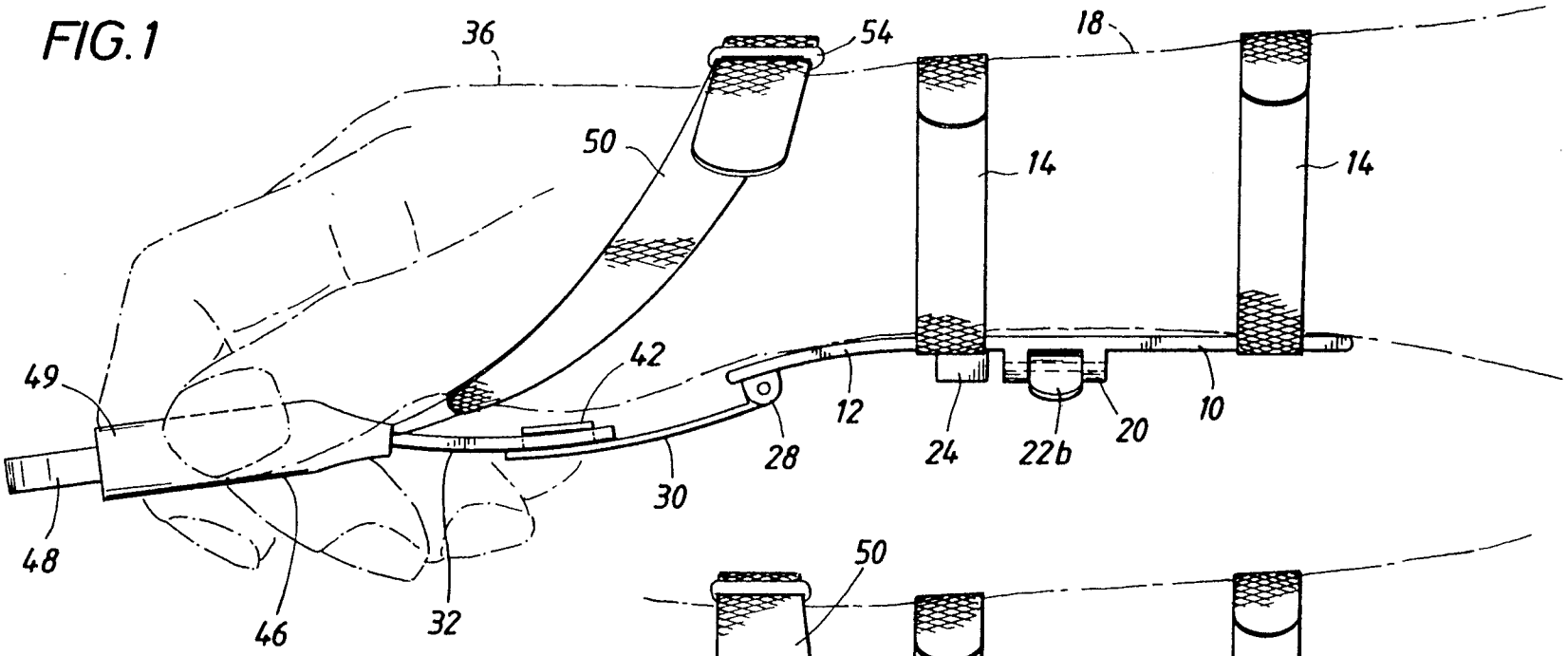
FIG. 1 is a side elevational view of the device in operative or extended position on the user's arm.
Figure 2:
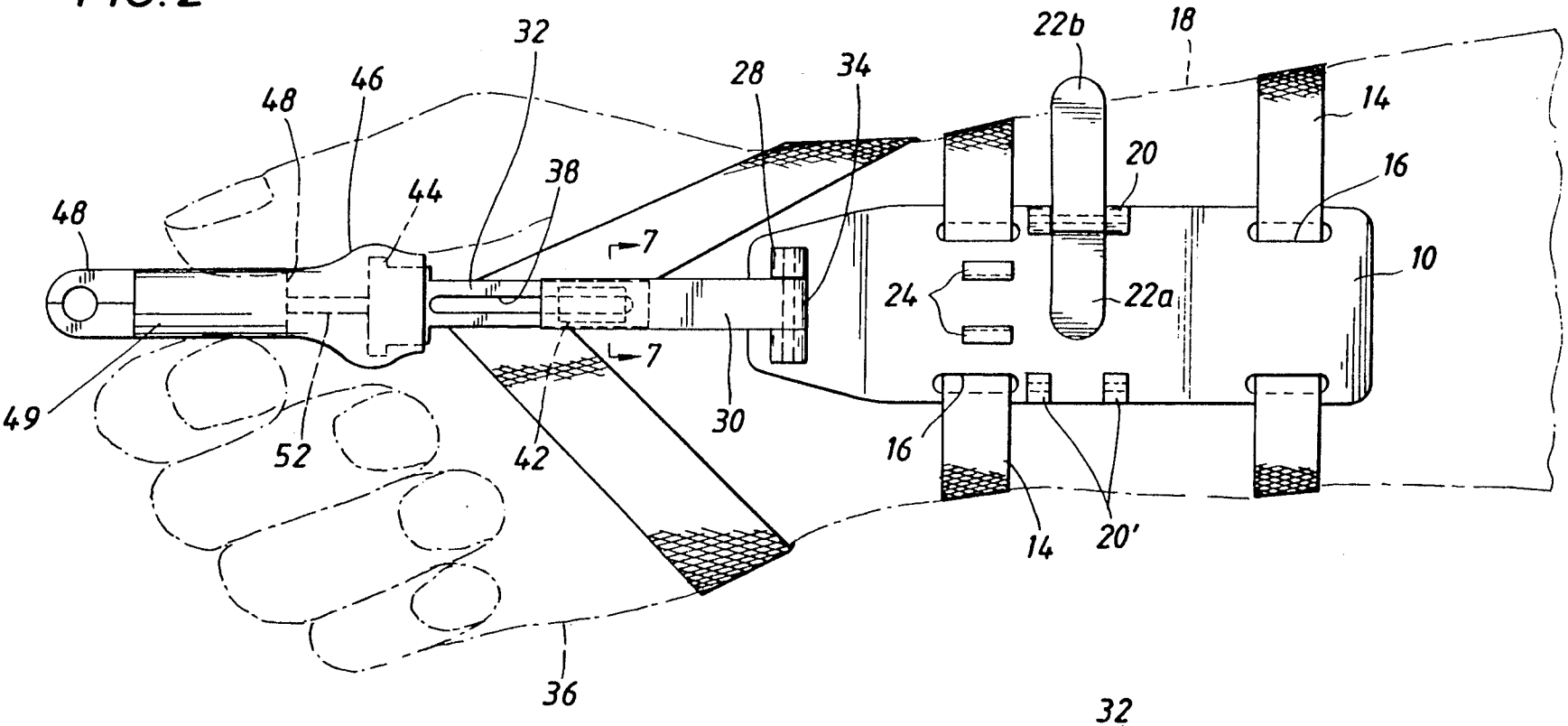
FIG. 2 is a bottom plan view of FIG. 1.
Figure 7:
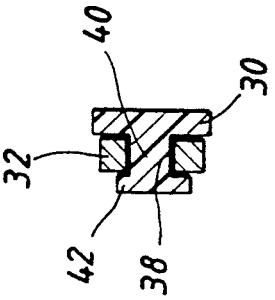
FIG. 7 is a detailed cross-sectional view taken on the line of 7—7 of FIG. 2.

Referring to FIGS. 1 and 2, there is shown a device according to a presently preferred embodiment of the invention. The device includes a plate-like base 10 sized to fit along the inner side of the forearm of a human, just adjacent the wrist, and without extending laterally beyond the arm. The forward end of the base 10 may be curved, as indicated at 12 to more nearly follow the contour of the arm and allow flexing of the wrist for comfort. A pair of arm straps 14 are carried by the base 10 and spaced from each other along the length of base 10. More specifically, each of the straps 14 passes through a respective pair of openings 16 in the base 10 so that they extend generally laterally from base 10. Straps 14 can be used to releasably secure the base 10 to the arm 18 of the user by overlapping the ends of the straps as shown in FIG. 1 and securing the overlapped ends by hook and pile type fasteners, such as sold under the trademark "Velcro." This also allows for adjustability for accommodating different sized arms. It will be appreciated that other variations are possible. For example, instead of hook and pile type fasteners, buckles may be employed, or the straps 14 could be continuous loops formed at least partially of an elastic material which allows the user's hand to be slipped through them, and also allows for the aforementioned adjustability.

Approximately midway along the length of base 10, and toward one side of the undersurface of base 10, there is formed a clevis 20 for pivotally mounting an actuator lever which lies transverse to the base 10 and has a first arm **22*a* overlapping base 10 and a second arm 22*b* projecting laterally outwardly beyond the base 10, and preferably sized to also project slightly beyond an average sized arm 18. It can be seen that the arrangement and pivotal mounting of lever 22*a*, 22*b* is such that, by manipulating the outer arm 22*b*, the inner arm 22*a* can be caused to move toward and away from the undersurface of base 10**.

An alternate clevis 20' may be provided on the other side of base 10. Lever **22*a*, 22*b* may be removable and selectively mountable on either clevis 20 or clevis 20'** to adapt the device for right-handed or left-handed people.

Just forward of lever **22*a*, 22*b*, and laterally spaced from each other, are a pair of lugs 24 projecting down from the underside of base 10. As best seen in FIG. 5, the lugs 24 have snap projections 26** projecting laterally inwardly from their outer ends.

Near the forward end of base 10, and on its undersurface, there is another clevis 28 to which a carrier is pivotally mounted. More specifically, the carrier comprises inner and outer members 30 and 32, respectively. Carrier members 30 and 32 are elongate and generally flattened, in terms of width to depth ratio, although their centerlines are slightly curved to more nearly match the configuration of the base 10, when in the stowed position (FIG. 3), and the user's hand, when in extended position (FIG. 1). The inner member 30 includes the connector end 34 of the carrier, which connector end 34 is pivotally mounted on the clevis 28 so that the carrier can move between a stowed position, as shown in FIGS. 3 and 4, lying along the base 10 and the user's forearm, and an extended or operative position, as shown in FIGS. 1 and 2, extending forward from base 10 to lie generally along the palm of the user's hand 36.

Figure 3:
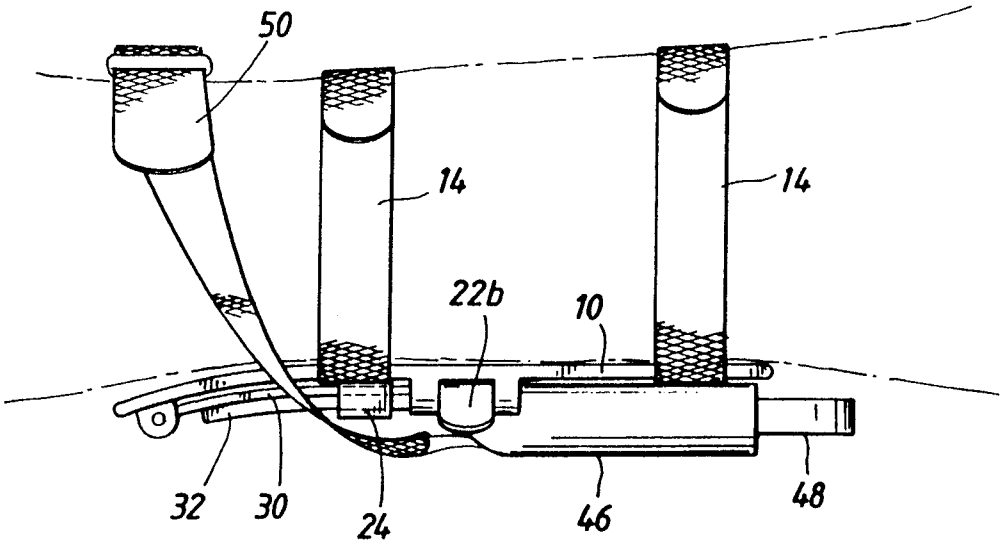
FIG. 3 is a view similar to FIG. 1, but showing the device in stowed position.

The outer member 32 of the carrier overlaps the inner member 30 in such a manner that, when the device is in the stowed position of FIGS. 3 and 4, the inner member 30 lies closest to the base 10. Outer member 32 has a lengthwise slot 38, and a key 40 integral with inner carrier member 30 extends through the slot 38, being retained there by an enlargement 42 carried by the key 40 on the opposite side of member 32 from member 30. While, for simplicity, members 30, 40 and 42 have been shown as being in one piece, it would be understood by those of skill in the art that, for assembly purposes, at least the enlargement 42 and the main body of the inner member 30 could be separately formed, and then bonded together after assembly with outer member 32. Other arrangements are, of course, possible, for example the assembly might be permitted by forming outer member 32 in two parts which are fixed together after key 40 is placed in slot 38. In any case, this linkage allows for free sliding telescopic movement between members 30 and 32.

The outer or free end of member 32 is formed with a T-head 44 for retaining one end of a flexible plastic or elastomeric tube 46, which also forms a part of the carrier. Alternatively, a short cylinder with an outer radial flange, or other form of connector, could be used. The other end of the tube 46 receives and is affixed to a bow release 48.

A load bearing wrist strap 50 forms a generally teardrop shaped loop, the apex of which is affixed to a flexible cord or the like 52. This cord 52 passes through an opening in tube 46 and is fixed to bow release 48 as best seen in FIG. 2. The size of the loop formed by strap 50 is made adjustable by means of a buckle 54. The flexibility of cord 52 and tube 46 allow swiveling movement of the bow release 48 and the attached portion of tube 46 (which forms the free end of the carrier) with respect to both the strap 50 and the rigid portions 32, 30 of the carrier. Because the strap 50 is directly connected to the bow release 48, and thence to the outer end 49 of the carrier, and because of the telescoping joint between members 30 and 32, the force of drawing the bow string is transferred from the release 48 through the cord 52 and strap 50 to the user's hand 36, and not to the base 10 and the user's forearm 18. As in conventional center-mount releases, the user's fingers are only employed to properly position and actuate the release 48. It has been found, somewhat surprisingly, that if the force is allowed to be transferred to the base 10 and/or the forearm 18, the bow can not be shot properly and accurately.

When the release 48 is not in use, the carrier 30, 32, 46 can be pivoted back to the stowed position of FIGS. 3 and 4, and it is particularly noted that this allows the strap 50 to remain loosely encircling the base of the user's hand, but without interfering with other uses of that hand.

As previously mentioned, the inner carrier member 30 lies adjacent the plate 10 in the stowed position. As best shown in FIG. 5, member 30 is wider than member 32. More specifically, member 30 is slightly wider than the distance between projections 26 of the latching lugs 24, whereas member 32 is sized to fit between projections 26. Thus, member 30 cooperates with lugs 24 to form a snap-type latching mechanism for releasably retaining the carrier in its stowed position. The amount of overlap between projections 26 and member 30 has been slightly exaggerated for purposes of illustration, but it should be understood that, for ease and quietness of release, the overlap should be very slight. Noise can be further reduced by forming members 30 and 32 and/or lugs 24 of a suitable synthetic material and/or by use of suitable padding.

Still referring to FIG. 5 in conjunction with FIG. 6, it can be seen that lever arm **22*a* underlies member 30 in the stowed position. Thus, if the user simply brushes lever arm 22*b* against a suitable object, the lever 22*a*, 22*b* can be pivoted as indicated in FIG. 6 to snap member 30 out of the lugs 24**.

Many variations of the preferred embodiment described above are possible. For example, instead of a center mount style wrist strap 50, the device could be provided with a different type of interface member, such as a pistol grip type, or if the holster is for use with another type of tool, still other interface devices may be appropriate, or the interface device may be unnecessary. Of course, any type of bow release mechanism can be used, and the device 48 is only a general or diagrammatic illustration of an exemplary release. Still other variations will suggest themselves to those of skill in the art. Thus, it is intended that the scope of the invention be limited only by the claims.

I claim:

1. A holster for a bow string release mechanism comprising:

a base adapted to be releasably mounted on the inner forearm of a user;

an elongate carrier having a free end adapted to be connected to a bow string release mechanism and a connector end pivotally connected to the base for free-swinging movement of the carrier between a stowed position overlying the base and an extended position projecting from the base for alignment with the user's hand;

the base and the carrier having inter-engageable latching formations for releasably retaining the carrier in its stowed position;

an actuator inter-engageable between the base and the carrier for selectively releasing the latching formations; and an interface device adapted to be connected to the bow string release mechanism and connected to the free end of the carrier and also adapted to engage the user's hand;

the carrier in the extended position providing slack between its connector and free ends when a bow string release mechanism is connected to said free end and the interface is engaging the user's hand, whereby forces may be transferred, independently of the carrier, between the user's hand and a bow string in a bow string release mechanism.

2. The holster of claim 1 wherein the carrier is adapted for lengthwise extension and foreshortening, and the interface device is attached for joint movement with the free end.

3. The holster of claim 2 wherein the carrier comprises an inner member including the connector end of the carrier and an outer member including the free end, the inner and outer members being interconnected for lengthwise telescopic movement, and the interface device being attached to the outer member.

4. The holster of claim 3 wherein the outer member is adapted to permit swiveling movement of the free end with respect to the connector end.

5. The holster of claim 4 wherein the interface device is attached to the portion of the outer member of the carrier which can swivel.

6. The holster of claim 5 wherein the interface device is attached to a bow string release which in turn is secured to the free end of the carrier.

7. The holster of claim 4 wherein the free end is defined by a flexible tube having one end secured to an outer end of a rigid portion of the outer member and the other end, forming the free end of the carrier, secured to a bow string release.

8. The holster of claim 3 wherein said inner and outer members have respective flattened portions, the flattened portion of one of the members having a lengthwise slot, and the flattened portion of the other member having a key disposed in the slot to provide the telescopic movement.

9. The holster of claim 8 wherein the latching formations comprise a pair of opposed, laterally spaced lugs upstanding from the base and having laterally inward projections sized to allow a portion of the carrier to snap therebetween.

10. The holster of claim 9 wherein said actuator comprises a lever pivotally mounted on the base and having one arm underlying the carrier in its stowed position and another arm projecting laterally from the base.

11. The holster of claim 10 comprising means for selectively mounting the lever on either side of the base.

12. The holster of any one of claims 1-10 wherein the interface device comprises a strap forming a closed loop.

13. A holster for a bow string release mechanism comprising:

a base adapted to be releasably mounted on the inner forearm of a user;

an elongate carrier comprising an inner member having a connector end pivotally connected to the base for movement of the carrier between a stowed position overlying the base and an extended position projecting from the base for alignment with the user's hand, and an outer member including a free end, the outer member being adapted to be connected to a bow string release mechanism and to permit swiveling movement of the free end with respect to the inner member, and the inner and outer members having rigid portions interconnected for lengthwise telescopic movement;

the base and the carrier having inter-engageable latching formations for releasably retaining the carrier in its stowed position;

an actuator inter-engageable between the base and the carrier for selectively releasing the latching formations and having an operator portion projecting laterally from the holster; and an interface device adapted to be connected to the bow string release mechanism and attached to the outer member of the carrier and also adapted to engage the user's hand.

14. The holster of claim 13 wherein the interface device is attached to the portion of the outer member of the carrier which can swivel.

15. The holster of claim 14 wherein the interface device is attached to a bow string release which in turn is secured to the free end of the carrier.

16. The holster of claim 13 wherein the pivotal connection of the inner member of the carrier to the base is of a free swinging type;

the latching formations comprise snap formations on the base inter-engageable with the carrier; and wherein the actuator comprises a lever pivotally mounted on the base and having one arm underlying the carrier in its stowed position and the other arm so projecting laterally from the base.

17. A holster for a tool comprising:

a base adapted to be releasably mounted on the inner forearm of a user;

an elongate carrier having a connector end pivotally connected to the base for free-swinging movement of the carrier between a stowed position overlying the base and an extended position projecting from the base for alignment with the user's hand, and a free end adapted for carrying a tool, the carrier being adapted for lengthwise extension and foreshortening;

the base and the carrier having inter-engageable latching formations for releasably retaining the carrier in its stowed position, the latching formations comprising a pair of opposed, laterally spaced lugs upstanding from the base and having laterally inward projections sized to allow a portion of the carrier to snap therebetween;

an actuator inter-engageable between the base and the carrier for selectively releasing the latching formations and having a laterally projecting operator portion distal the locus of the user's hand, the actuator comprising a lever pivotally mounted on the base and having one arm underlying the carrier in its stowed position and another arm so projecting laterally from the base.

18. The holster of claim 17 wherein the carrier comprises an inner member including the connector end and an outer member including the free end, the inner and outer members being interconnected for lengthwise telescopic movement.

19. The holster of claim 18 wherein the outer member is adapted to permit swiveling movement of the free end with respect to the connector end.

20. The holster of claim 18 wherein the inner and outer members have respective flattened portions, the flattened portion of one of the members having a lengthwise slot, and the flattened portion of the other member having a key disposed in the slot to provide the telescopic movement.

21. A holster comprising:

a plate-like base adapted to be releasably mounted on the inner forearm of a user, the base having a forward end for disposition adjacent the user's wrist and curved to allow flexing of the wrist;

an elongate carrier having a free end adapted for connection to an object and a connector end connected to the base for free-swinging movement of the carrier between a stowed position overlying the base and an extended position projecting from the base for alignment with the user's hand;

the base and the carrier having latching formations for releasably retaining the carrier in its stowed position, the latching formations comprising a pair of opposed, laterally spaced lugs upstanding from the base and having laterally inward projections sized to allow a portion of the carrier to snap therebetween; and an actuator inter-engageable between the base and the carrier for selectively releasing the engageable members, the actuator comprising a lever pivotally mounted on the base and having one arm underlying the carrier in its stowed position and another arm projecting laterally from the base.

22. The holster of claim 21 wherein the carrier comprises an inner member including the connector end and an outer member including the free end, the inner and outer members being interconnected for lengthwise telescopic movement.

23. The holster of claim 22 wherein the outer member is adapted to permit swiveling movement of the free end with respect to the connector end.

24. The holster of claim 22 wherein the inner and outer members have respective flattened portions, the flattened portion of one of the members having a lengthwise slot, and the flattened portion of the other member having a key disposed in the slot to provide the telescopic movement.

* * * * *